US005473800A

United States Patent [19]

Hatomoto et al.

[11] Patent Number: 5,473,800

[45] Date of Patent: Dec. 12, 1995

[54] SEPARABLE FASTENING COMPONENT

[75] Inventors: Isamu Hatomoto, Kobe; Yukitoshi Higashinaka, Fukui, both of Japan

[73] Assignee: Magictape Co., Ltd., Fukui, Japan

[21] Appl. No.: 219,359

[22] Filed: Mar. 29, 1994

[30] Foreign Application Priority Data

Apr. 8, 1993 [JP] Japan ..... 5-107695

[51] Int. Cl.[6] ..... A44B 13/00

[52] U.S. Cl. ..... 24/442; 24/446; 24/449; 24/450

[58] Field of Search ..... 24/442, 446, 447, 24/448, 449, 450, 306

[56] References Cited

U.S. PATENT DOCUMENTS

| | | | |
|---|---|---|---|
| 3,009,235 | 11/1961 | De Mestral | 24/448 |
| 3,136,026 | 6/1964 | De Mestral | 24/449 |
| 4,198,734 | 4/1980 | Brumlik . | |
| 4,842,916 | 6/1989 | Ogawa et al. . | |
| 4,920,617 | 5/1990 | Higashinaka . | |
| 4,931,344 | 6/1990 | Ogawa et al. . | |
| 5,058,245 | 10/1991 | Saito . | |
| 5,191,166 | 3/1993 | Smirlock et al. | 89/36.02 |
| 5,231,738 | 8/1993 | Higashinaka . | |
| 5,235,731 | 8/1993 | Anzai et al. . | |

FOREIGN PATENT DOCUMENTS

| | | |
|---|---|---|
| 046465 | 3/1982 | European Pat. Off. . |
| 0052338 | 5/1982 | European Pat. Off. . |
| 45-12340 | 5/1970 | Japan . |
| 4-123106 | 11/1992 | Japan . |
| 2009257 | 6/1979 | United Kingdom . |

OTHER PUBLICATIONS

Patent Abstracts of Japan, vol. 11, No. 192 (C–429), Jun. 19, 1987, JP–A–62 013 433, Jan. 22, 1987.

*Primary Examiner*—Victor N. Sakran

*Attorney, Agent, or Firm*—Oblon, Spivak, McClelland, Maier, & Neustadt

[57] ABSTRACT

A male separable fastening component has a base and, provided thereon, a multiplicity of independent fastening elements, the fastening elements each comprising a bundle of raised fibers with a grape cluster-like aggregate of swollen heads consolidated together by fusion of the fiber ends and a trunk having a shape tightening at the root and broadening towards the swollen heads-aggregate; and a separable fastener utilizes this type separable fastening component.

8 Claims, 2 Drawing Sheets

SEPARABLE FASTENING COMPONENT

BACKGROUND OF THE INVENTION

1. Field of the Invention

The present invention relates to a separable fastening component being widely used in the field of clothing. More specifically, the present invention relates to a thin, flexible separable fastening component having a sufficient engaging force and an agreeable touch, which is suitably used for disposable diapers and like applications that directly or indirectly contact the human skin.

2. Description of the Prior Art

Known separable fasteners include what is known as hook-type separable fastener comprising a female fastening component comprising a base and a multiplicity of loops provided thereon (hereinafter sometimes referred to as "female surface") and a male fastening component comprising a base and, provided thereon, a multiplicity of hook-shaped fastening elements formed from thick monofilaments (see, for example, Japanese Patent Publication No. 522/1960) and a what is known as mushroom-type separable fastener comprising a male fastening component comprising a base and, provided thereon, a multiplicity of mushroom-shaped fastening elements formed by fusing and swelling the ends of thick thermoplastic resin monofilaments with a hot plate or like means and the above female separable fastening component (see, for example Japanese Patent Publication No. 22501/1978 and Japanese Patent Application Laid-open No. 38734/1974). With both of these separable fasteners, the hook-shaped fastening elements or mushroom-shaped fastening elements of the male separable fastener (hereinafter sometimes referred to as "male surface") engage with the loops of the female separable fastener, to produce an engaging force. Accordingly, these fasteners are of male-female type. On the other hand, also known is a male-male type (homo-type) which uses a combination of the same two male fastening components, comprising fastening elements comprising a multiplicity of bundles which comprises a plurality of monofilaments with their tips being fused together (see Japanese Patent Publication No. 12340/1970 and Japanese Utility Model Application Laid-open No. 123106/1992).

However, the above hook-type male separable fastening component should have a limited height of the hooks, since the hooks are prepared by inserting the tip of a clipper into loops constituting precursors for the hooks and hence the height of the loops, i.e. that of the hooks formed therefrom, is so restricted as to be able to introduce the clipper. Consequently, attempts to make thin the hook-type fastening component have only succeeded in obtaining a minimum thickness including the base of about 1.3 mm. This type male separable fastening component, utilizing thick monofilaments for hooks, has another disadvantage of giving a coarse touch.

On the other hand, while known mushroom-type male separable fastening components comprising a multiplicity of mushroom-shaped elements formed from single monofilaments also use, generally, thick monofilaments to obtain an engaging force of a level suited for practical purposes, development of a thinner, more flexible type is desired for use in disposable diapers and like uses. To make thin a mushroom-type male separable fastening component may be possible to some extent, even with thick monofilaments, by increasing the amount fused of the tips to decrease the height of the fastening elements. However, the thickness (thinness) of the fastening component is still limited due to the following points. That is, making thin to a level below a limit requires increasing the amount fused of thick monofilaments having a large heat capacity, thereby prolonging the heating time, and also requires placing a heat source such as high-temperature hot plate near the base surface. As a result, the base tends to deform so that the entire separable fastening component will curl or wave.

Besides, mushroom-type fastening elements comprising single monofilaments lose their engaging force just when their swollen heads are torn off during use. This type fastening element further has the following drawback. Use of polypropylene or polyethylene monofilaments with low melting point assures formation of swollen heads with sharp-angled bottom, i.e. true mushroom shape, which hardly permits the loops having engaged therewith to become disengaged and thus produces high engaging force. However, the swollen heads tend to be torn off when the counterpart female component is peeled off, thus being of poor durability. Thermoplastic monofilaments other than the above polyolefins, such as nylon and polyester, are readily dyeable and have high melting point so that ironing can cause no fear of fusing. In particular, nylon has the advantage of exhibiting soft and agreeable touch under the usual conditions of temperature and humidity. However, use of nylon or polyester monofilaments causes the resulting swollen heads to have spherical shape, so-called "match-shape", thereby being incapable of providing high engaging force. See, for example, Journal of the Textile Institute, Vol. 79, No. 4, pages 672–675 (1988).

As described so far, conventional male separable fastening components, both hook-type and mushroom-type, use thick monofilaments for their fastening elements and are hence difficult to decrease the thickness and have coarse hand lacking flexibility. Use of fine monofilaments can produce no good engaging force for practical purposes, while they should give small thickness and good flexibility though.

Examples of the afore-mentioned separable fastening components having fastening elements each of which comprises a plurality of monofilaments whose ends are fused together are as follows. Japanese Patent Publication No. 12340/1970 discloses a separable fastening component comprising a base and, provided thereon, a multiplicity of "rail-shaped" (i.e. resembling a bar like a railroad rail having a T-shaped cross-section) fastening elements comprising a line of bundles of raised filaments whose ends are successively fused together. However, this type separable fastening component, having rail-shaped fastening elements, engages with its counterpart by insertion of the rail-shaped fastening elements into each other. Thus, this constitutes so-called a "homo-type" separable fastener and is not intended to engage with a female fastening component. With this type, the base is difficult to bend so that the entire fastening component has also insufficient flexibility. Japanese Utility Model Application Laid-open No. 123106/1992 discloses a fastening component comprising a base and mushroom-type fastening elements each of which comprises a plurality of monofilaments raised from different points on the base surface, the heads of the monofilaments being integrally fused together. However, this type fastening component is, engaging with its counterpart by insertion of the fused head parts into each other, also used for homo-type. This type, with the monofilaments constituting the fastening elements having a large fineness of 250 to 1,300 deniers, is not suited for engagement with a female fastening component. This type has a coarse touch and, further, a large thickness of 2 to 5 mm of the base alone, thereby being not flexible. In any case, the above-described separable fastening components are not suitable for direct engagement with a thin, inexpensive female surface, such as loop- or pile-stuff being used for disposable diapers or the like.

SUMMARY OF THE INVENTION

Accordingly, an object of the present invention is to provide a novel thin, flexible separable fastening component having sufficient engaging force that solves the above problems and is suitable for use in disposable diapers and the like.

Another object of the present invention is to provide a male-female type separable fastener utilizing the above novel separable fastening component.

As a result of an intensive study to solve the above problems, the present inventors have found that formation of a multiplicity of mushroom-type fastening elements each from a bundle of raised fibers, in particular those having small fineness, followed by integral fusion of the tips of the fibers gives, surprisingly, a separable fastening component, that can then give a separable fastener fit for the purpose of the invention.

Thus, the present invention provides a separable fastening component comprising a base and, provided thereon, a multiplicity of independent fastening elements, said fastening elements each comprising a bundle of fibers raised from substantially one point on the surface of the base, said fibers constituting said bundle each having a fineness of 5 to 100 deniers and having a swollen head, the swollen heads of said fibers being at least partially consolidated.

The present invention further provides a male-female type separable fastener comprising a male fastening component of the above fastening component.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
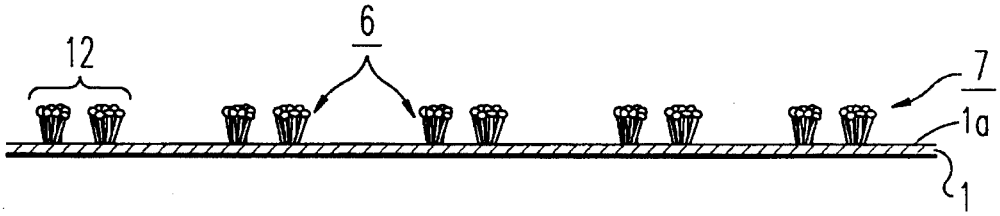
FIG. 1 is a schematic side view of an example of the separable fastening component according to the present invention.
Figure 2:
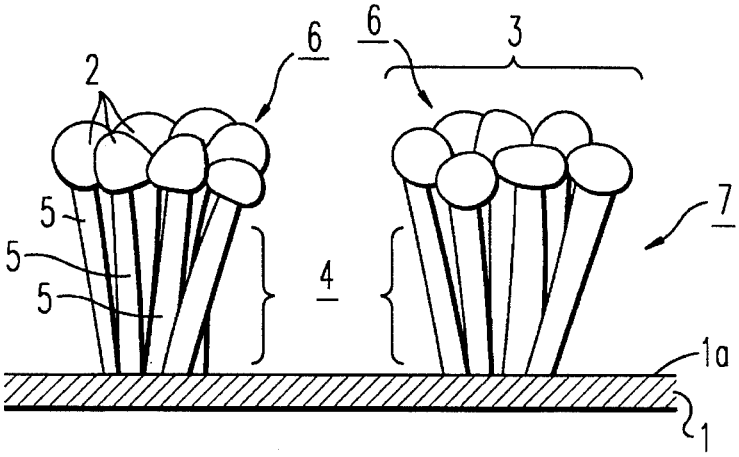
FIG. 2 is an expanded side view showing examples of the fastening elements of the separable fastening component according to the present invention.

Embodiments of the separable fastening component of the present invention is described by reference to FIGURES. In FIG. 1, a separable fastening component 7 comprises a base 1 and, provided on the surface 1*a* thereof, a multiplicity of independent fastening elements 6. As shown in FIG. 2, each of the fastening elements 6 consists of a bundle. (supporting part or trunk) 4 of raised fibers, the bundle comprising a plurality of thin single fibers 5 having bottoms raised from substantially one point on the base surface, and an aggregate 3 having a toughened periphery and comprising the swollen heads 2 each formed at the end of the single fiber 5 constituting the bundle 4, at least part of the heads being fused together to consolidate.

Figure 3:
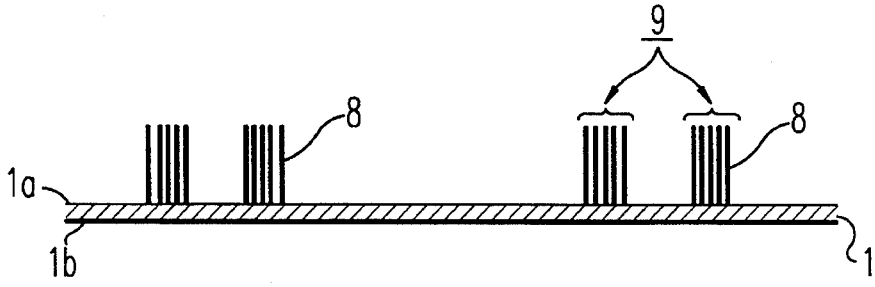
FIG. 3 is a side view of bundles of raised fibers provided on a base and each constituting a precursor for a fastening element.

The separable fastening component 7 may be produced by a process which comprises forming, as shown in FIG. 3, on the surface 1*a* of a base a multiplicity of bundles 9 of raised fibers constituting precursors for fastening elements 6 and then forming the fastening elements 6 by fusion of the end part of each of the fibers constituting the bundle 9 of raised fibers. This process is described in more detail later herein.

To obtain a thin, flexible separable fastening component having a sufficient engaging force, the raised single fibers 8 constituting the bundle 9 of raised fibers, which bundle is a precursor for the fastening element 6, has a fineness of 5 to 100 deniers, preferably 10 to 50 deniers. With too small a fineness, the resulting fastening element has poor elasticity and hardly produces a sufficient engaging force. On the other hand, if the single fiber 8 has too large a fineness, which increases its heat capacity, the heating time for fusion of the end of the bundle 9 of raised fibers will become long, thereby making it difficult, upon heat fusion operation, to position the heat source close to the base surface la without adversely affecting the quality of the finished fastening component. As a result, the obtained separable fastening component 7 cannot be desirably thin, thereby giving a coarse touch lacking flexibility. In the present invention, the raised single fibers 8 have far smaller fineness compared with those single fibers that have a fineness of 250 to 1,300 deniers and are used for the known homo-type separable fastening components. The above problem upon heat fusion is therefore eliminated and the object of the present invention of providing a thin and flexible fastening component is thus achieved.

It is desirable that the bundle 9 of raised fibers used in the present invention have a total fineness of 50 to 300 deniers, more preferably 150 to 250 deniers. Deviation from the above range is not preferred for the same reasons in the case of the above single fiber fineness.

It is also desirable that the number of raised single fibers 8 constituting the bundle 9 of raised fibers be in a range of 4 to 60, more preferably in a range of 7 to 20. If the number is too large or too small, the resulting bundle 9 will become too thin or too thick, resulting in poor engaging force or production of adverse effect on the base caused by heat fusion operation and a coarse touch, like in the cases of deviation from the preferred range of the fineness of the bundle 9 of raised fibers or that of raised single fibers 8.

In summary, for the purpose of obtaining the desired thin, flexible separable fastening component of the present invention, it is most desirable to make up the bundle 9 of fibers having a total fineness of 150 to 250 deniers from 7 to 20 pieces of raised fibers 8 each having a fineness of 10 to 35 deniers.

Besides, it is desirable to set the density of the fastening elements 6, i.e. that of the precursor bundle 9 of raised fibers, on the base surface 1*a*, at 50 to 200 pieces/cm$^2$, more preferably 80 to 160 pieces/cm$^2$. With the density being too low, a sufficient engaging force cannot be produced and the separable fastening component shows a coarse surface touch. On the other hand, with too high a density, which decreases the distance between adjacent fastening elements 6, it becomes difficult, when the fastening component is used as a male component, for the loops of a female fastening component to be inserted into spaces between the fastening elements 6 so that a sufficient engaging force is not obtained.

The raised fibers 8 constituting the bundle 9 of raised fibers preferably comprise a thermoplastic synthetic resin, such as polyethylene, polypropylene, nylon or polyester, in view of heat fusibility upon preparation of the fastening component.

There are no specific restrictions with respect to the material and type of the base 1 on which the bundle 9 of raised fibers, and woven or knit fabrics from fibers of polypropylene, nylon or polyester are usable, as well single-layer or multi-layer structures made of resins. Elastic bases are also usable, since the fastening component 7 of the present invention is not of inter-inserting type that can maintain a good engaging force only when the distances between adjacent fastening elements are kept constant.

Figure 4:
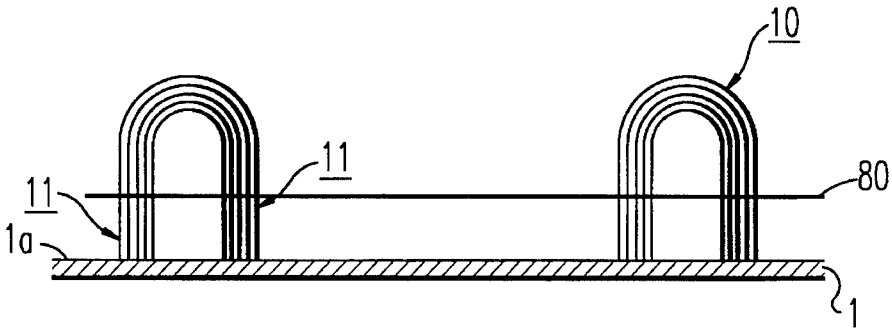
FIG. 4 is a side view showing an example of a loop comprising collected fibers and constituting a precursor for a fastening element.

The bundle 9 of raised fibers (FIG. 3) as a precursor for the fastening element 6 is formed, for example, by a process which comprises forming loops 10 comprising collected fibers on one surface 1*a* of a base 1, as shown in FIG. 4, by using the known weaving or knitting technique and then shearing the loops 10 with a shearing machine at a position (e.g. the position shown by 80 in FIG. 4) corresponding to the designed thickness of the resulting separable fastening component.

It is also possible to employ a process which, though not shown, comprises joining 2 sheets of bases via connecting piles and then cutting the obtained double plush woven fabric into two pile fabrics. The flocking technique is also applicable to forming the bundle 9 of raised fibers. Even with the half-division or flocking, setting the designed height upon that operation, it is often desirable to conduct supplementary shearing to make even the height and achieve a good touch to the human skin. The shearing may be omitted here. For the shearing, there can be used a shearing machine generally used for napping woolen fabrics and consisting of a spiral cutter and an under knife.

The bundles 9 of raised fibers, or the fastening elements 6, in particular the trunks 4 thereof, may not necessarily project vertically from the base surface. Inclined positioning of the fastening elements 6 to the base surface makes it difficult for the loops of a female surface once engaged therewith to disengage, thereby increasing the engaging force between the separable fastening component and a female surface.

To swell the end part of the raised fibers 8 constituting the bundle 9 of raised fibers and, at the same time, at least partially consolidate the swollen heads 2 to form the fastening element 6, it is best to employ heat fusion, which can readily and simply achieve the purpose of the present invention and assures effective production.

This heat fusion comprises, while conveying a base 1 provided with projecting bundles 9 of raised fibers, heating it from the side of the bundles, and fusing the end part of each of the raised fibers 8 to swell and further to consolidate by at least partially fusing together the swollen heads 2. The heating may be conducted with a high-temperature hot plate or high-temperature gas flame, the latter being preferred because it is more efficient and minimizes thermal deformation of the base 1. The swollen heads 2 may have any optional size but, as an example, where they have nearly spherical shape, the diameter of the spheres are preferably about 1.1 to 3 times the fineness of the raised fibers 8 in view of the resulting engaging force. If the sphere, diameter is less than this range, loops having been engaged therewith will tend to be disengaged. If the diameter exceeds this range, the loops will have some difficulty in engagement, whereby the engaging force tends to decrease.

In the present invention, the bundles 9 of raised fibers to form fastening elements are, as described above, constituted of thin raised fibers 8, which have smaller heat capacity compared with thick fibers. Consequently, fusion of the end part of the fibers requires shorter time or, the fusion can occur almost instantaneously when high-temperature gas flame is used. It then becomes possible to heat only the end part of the raised fibers 8 locally, which minimizes adverse effect on the base 1 caused by the heating, whereby the thin, flexible separable fastener achieving the first object of the present invention can be obtained. For the preparation of the fastening elements, there may also be used, besides heat fusion, dissolution with a solvent, formation and the simultaneous consolidation of the swollen heads with a resin (resin baking process) or like processes.

There are no specific restrictions with respect to the upper limit of the thickness of the separable fastening component 7 of the present invention, as with conventional fastening components. The thickness (inclusive of the base 1 and fastening elements 6) can thus be generally about 1.5 mm. However, with respect to the lower limit, the separable fastening component 7 of the present invention can possess as thin a thickness as 0.3 mm, which is preferable. Too large a thickness cannot produce a sufficient engaging force, while with too small ones the base 1 undergoes thermal deformation during heat fusion operation of the end part of the bundles 9 of raised fibers.

In the present invention, the expression "the swollen heads are at least partially consolidated" does not necessarily mean a state where all of the swollen heads 2 of the raised fibers 5 of the fastening element 6 are integrally fused together. Rather, it means that the resulting fastening element is so consolidated as to exert a sufficient force of engagement with loops of a female surface. That is, the expression includes a state where, in one fastening element, part (at least one) of the swollen heads of the single fibers 5 is not fused with an aggregate 3 containing residual major part of single fibers 5 with their swollen heads being integrally fused together, one containing several small separate aggregates containing raised fibers all the swollen heads of which are integrally fused together, and combinations of the foregoing. The degree of integral fusion of the swollen heads 2 is preferably such that the resulting aggregate 3 containing these swollen heads maintains a roughened profile originating from individual swollen heads and thus each of the swollen heads is visible in the aggregate 3, in view of the resulting engaging force. In this case, the toughened profile makes it difficult for loops having once been engaged to disengage again, thereby increasing the engaging force.

The thickness can be optionally adjusted within the above range by appropriately selecting the type of a base 1, the features, e.g. material and thickness, of the raised fibers 8 constituting the bundle 9 of raised fibers, the shearing of the bundles of raised fibers, heating conditions of the end part of the bundles of collect raised fibers and like conditions. In the present invention, the hardness of the fastening element 6 of the separable fastening component 7 is also adjustable by appropriately setting the above conditions.

The separable fastening component 7 of the present invention sometimes assumes, when the fastening elements are formed by the above process, a form in which, as shown in FIG. 2, the supporting parts or trunks 4 (bundles of raised fibers) for supporting the aggregates 3 of swollen head parts, tightens at its root part and broadens upwardly. This structure is preferable, since loops having been once engaged hardly disengage again. In other words, the fastening element 6 assumes in this case a shape in which its trunk is, when viewed from the side, somewhat like a shaving brush, with its bundle getting narrower, or tightening, towards the root part and broadening upwardly and, the entire element is, when viewed from above, i.e. the aggregate 3 is, somewhat like a cluster of grapes.

Another preferred embodiment of the separable fastening component 7 according to the present invention comprises fastening elements, each of which contains of single fibers 5 with swollen heads 2 having nonuniform shapes such as size and nonuniform height from the base surface (for example, 1*a*). In this case, generally, the fastening elements 6 provided on the same base have the aggregates 3 that are formed on the end part of the trunks 4 and have a shape like a cluster of grapes, the aggregates 3 being different from each other, in the shape, in the height from the base surface 1*a* and/or in the relative inclination direction based on the base surface 1*a*.

Further in the present invention, there may be provided pairs 12 of a fastening element 6 and the adjacent fastening element 6 located close to each other (see FIG. 1), which increases the number of chances where these fastening element become engageable with a loop of a female surface and thus increases the engaging force. In this case, formation of the fastening elements from loops 10 of fibers by the above described weaving or knitting technique can realize a pair of the bundles 9 and 9 of raised fibers originating from one and the same loop, i.e. a pair of two fastening elements 6 and 6 closely placed with each other, since the distance between the legs 11 and 11 of one loop 10 is, as shown in for example FIG. 3 or FIG. 4, generally smaller than that between the loop and the adjacent loop, when the density of the elements is in the preferred range in the present invention. The pairs 12 may be provided by half-division of a double plush woven fabric or by flocking.

Figure 5:
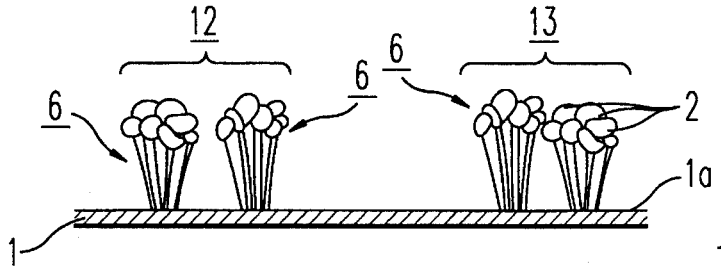
FIG. 5 is a side view showing an example of a fastening component comprising at least part of pairs of fastening elements are fused together on their swollen head parts.

Still another preferred embodiment of the present invention comprises the same pairs 12 as above, in part of which pairs the two independent fastening elements 6 and 6 constituting a pair are, as shown by a pair 13 in FIG. 5, consolidated by fusing together of the swollen heads 2 of at least one each of the single fibers constituting the two fastening elements 6. With this type fastening component, the two fastening elements constituting a pair support each other, so that they become more resistant against falling down by compression force exerted by ironing or like processes and have larger engaging force.

Figure 6:
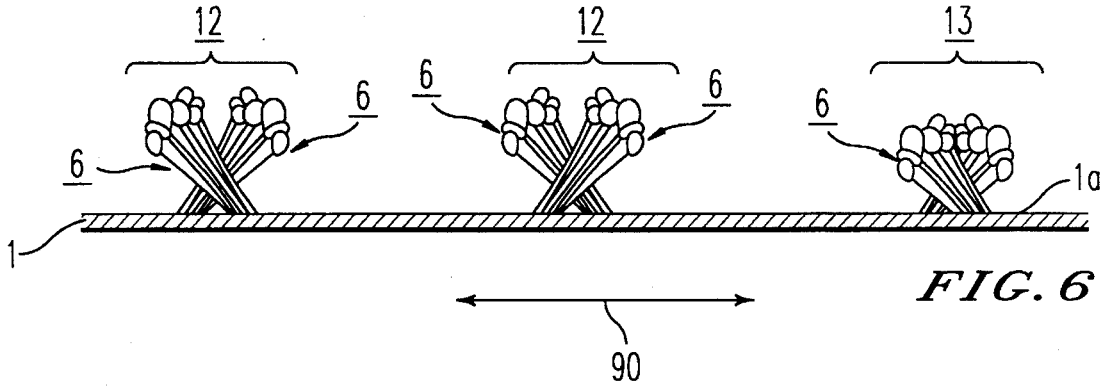
FIG. 6 is a side view showing an example of a fastening component comprising pairs of fastening elements, each of the pairs being provided in such positions as to form an X-shape and in part of the pairs the two constituting elements being fused together at their swollen head parts.
Figure 7:
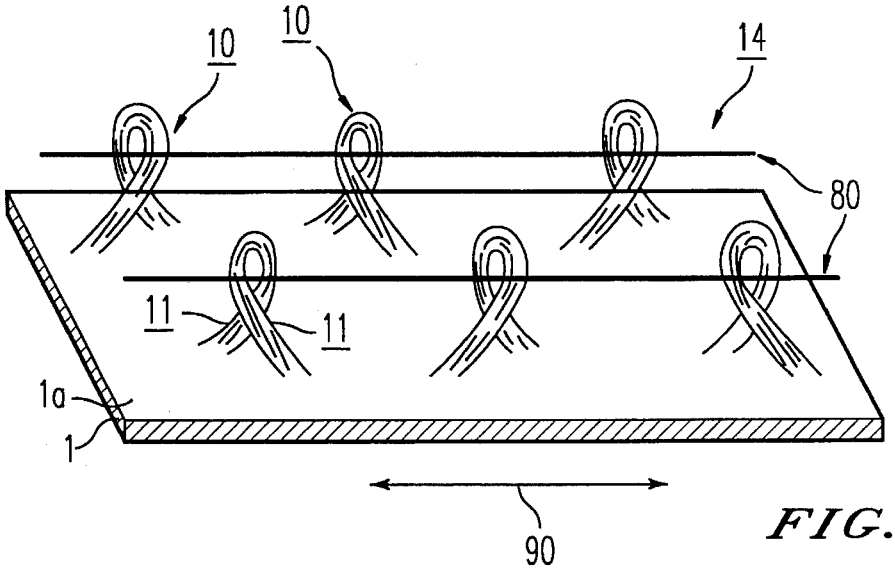
FIG. 7 is a schematic perspective view of an example of a precursor for a woven separable fastener comprising loops each comprising a bundle of fibers and having a twisted shape.

Yet another preferred embodiment of the present invention also comprises pairs of fastening elements 6 and 6, at least part of which are placed in a position where the two constituting elements assume an X-shape as shown by a pair 12 in FIG. 6. Yet another preferred embodiment of the invention comprises pairs of fastening elements, in at least part of which pairs the two fastening elements form an X-shape with their swollen head parts being fused together, as shown by a pair 13 in FIG. 6. The loops 10 of collected fibers formed by the weaving or knitting technique generally have a twisted shape, as shown on a precursor 14 for a separable fastening component in the perspective view of FIG. 7. From each of such loops 10, a pair of legs 11 and 11 can be processed into a pair of bundles 9 and 9 of raised fibers, and then into a pair 12 of fastening elements 6 and 6, which cross with each other to form an X-shape when viewed from the side. In this case, the position (height from the base surface) 80 of shearing of the loop 10 is higher than that of the intersecting point of the X-shaped fastening elements. These X-shaped embodiments, comprising fastening elements inclined in opposite directions, produce a high peel engaging force and, besides, produce high shear engaging forces in two opposite directions 90 along the length of the separable fastening component 7, shown for example in FIG. 6, that generally assumes a tape-like form. With this type, having fastening elements constituting pairs being inclined in opposite directions, produces a high engaging force because the number of chances of engagement increases, even when the opening directions of loops of a female surface are different. Furthermore, with part of such pairs having fastening elements consolidated by fusion with each other, the pair 13 having fused fastening elements resist against external force to disengage the loop of a female surface that has been once engaged with one of the elements, thereby increasing the engaging force. As stated above, the separable fastening component having pairs of fastening elements or those part of which are consolidated by fusing together at the swollen head part of the two constituting elements, this structure increasing the engaging force, is still thin and flexible because of the fastening elements being made up of thin fibers.

The following embodiments are also included in the scope of the present invention. That is, in the present invention, between a plurality of bundles 9 of raised fibers and/or in the bundles 9, there can be used by mixing therewith other single fibers having different fineness and/or material. These single fibers may not only be straight formed and of circular cross-section, but also be of irregular cross-sectional form, crimped fibers, spiral fibers or the like, singly or in combination. Irregular cross-sectional fibers are effective in increasing the dyeability (deep color, delustering effect) and elasticity, while crimped or spiral fibers are effective in improving the hand of the separable fastening component and the elasticity of the fastening element. The bundle 9 of raised fibers may be a twisted one. The fastening elements 6 may be provided on both surfaces 1*a* and 1*b* of a base. For this type, the total thickness is preferably about 0.4 to about 2 mm. The density of the fastening elements 6 is not necessarily uniform throughout the surface of a separable fastening component 7, and can be set differently from one surface (for example 1*a*) to another surface (for example 1*b*) of a base, or within one surface of a base. Besides, with the separable fastening components 7 according to the present invention and produced by the above weaving or knitting technique, the base may be provided with a backing comprising polyurethane or like resins to fix the fastening elements 6 on the base 1, thereby preventing the fastening elements from falling off of the base 1 or the base 1 from loosening starting on the cut edge. The backing thus increases durability. In this case, the backing agent may also adhere to the trunk part 4, for example the root part of the trunk part, of the fastening elements.

The features of the separable fastening component of the present invention having any one of the above structures are summarized below.

(1) Upon heating of bundles 9 of raised fibers to form fastening elements 6, use of thin raised fibers 8 for constituting the bundles 9 shortens the heating time. As a result, the heating can be conducted with the heat source placed close to the base 1, whereby the resulting separable fastening component 7 becomes thin and flexible.

(2) Where the separable fastening component is formed by the weaving or knitting technique, since single fibers constituting fastening elements and inserted into a woven or knit base are thin, the base itself, as well as the entire separable fastening component, can be made soft.

(3) The trunks 4 of fastening elements comprise thin single fibers 5, and hence the end parts of the fastening elements, being aggregates 3 of collected swollen heads formed by fusion, have roughened but still smooth profile. The separable fastening component 7 therefore has a soft and smooth touch and gives an agreeable feeling to the human skin.

(4) Although thin single fibers 5 are used for constituting each of the fastening elements 6, these fibers are integrally fused together at their end parts. As a result, the separable fastening component 7 exhibits high engaging force, because the single fibers 5 contribute, as a bundle, to resistance force against externally applied extending force upon peeling of the separable fastening component 7. This results in high engaging force, which becomes still higher with embodiments comprising pairs of the fastening elements connected by fusing together at their swollen head parts. Besides, the fastening elements, comprising such thin single fibers, elastically resist against a compressing force applied onto the surface, so that the separable fastening component has soft touch.

(5) When nylon or polyester fibers, having various advantages as materials for separable fasteners, are used for producing conventional mushroom-type fastening elements comprising monofilaments, they form swollen heads having a spherical shape that tend to come off from loops of a female surface and hence are not expected to show a high engaging force as seen with polyolefins. In the present invention, however, nylon or polyester fibers still give a separable fastening component having a high engaging force, since it comprises bundles each comprising thin fibers the swollen heads 2 of which are fused together to form an aggregate 3 having a shape of cluster of grapes and roughened circumference, thereby making difficult the coming off of loops. This fact makes it possible, in the present invention, to select and use various materials as single fibers for constituting fastening elements.

(6) The trunk 4 of each of the fastening elements has the shape tightening at the root part and broadening towards the end, which resists against coming off of a loop having once engaged therewith, thereby increasing the engaging force. Besides, a still higher engaging force is produced where each one of a multiplicity of the fastening elements contains bundle of single fibers with swollen heads 2 having nonuniform shapes and heights from the base surface and hence the multiplicity of the fastening elements themselves also have swollen head parts (aggregates) having nonuniform shapes and heights from the base, which structure permits ready engagement to be effected even with loops or piles of a counterpart female surface having nonuniform opening positions or sizes. Furthermore, pairs of the fastening elements increase the number of chances of engagement with loops of the female surface, thereby increasing the engaging force.

(7) With pairs of the fastening elements intersecting each other to form an X-shape, the resulting separable fastening component can efficiently engage with a female surface having loops opening in different directions and hardly disengage with loops having been once engaged therewith, thereby exhibiting a high peel engaging force and shear engaging force.

(8) The end of each of the fastening elements comprises an aggregate 3 of swollen heads of a plurality of single fibers, and hence the swollen head part becomes, upon engagement with loops, difficult to tear off, whereby the separable fastening component withstands repeated uses.

The above descriptions of the constitutions of the separable fastening component and separable faster of the present invention substantially solve the problems listed in this specification. An experiment example of the separable fastener and separable fastening component of the present invention is given below.

EXPERIMENTAL EXAMPLE

A nylon yarn of 110 deniers/30 filaments (hereinafter this type yarn is expressed as "110 d/30f") and a nylon yarn of 210 d/20f were used for warps and wefts, and loops, respectively. Loops were woven on one surface of the base fabric in a density of 60 pieces/cm$^2$ and then sheared to a total thickness inclusive of the base of 1.2 mm, to form bundles of raised fibers in a density of 120 pieces/cm$^2$. With high-temperature gas flame, swollen heads were formed on the end of each of the fibers and, at the same time, the swollen heads were integrally fused together. A backing agent was applied on a surface opposite to the fastening element side of the base. The obtained separable fastening component was tested for various properties and engagement characteristics and the results are shown in Table 1.

A conventionally used napped tricot formed from a 75 d/24f polyester yarn was selected as a female surface. The engaging force was measured in accordance with JIS L3416 (Separable Fastener). The terms "engaging force", "peel engaging force" and "shear engaging force" used herein correspond to the terms "bonding strength", "peeling strength" and "tensile shearing strength" as used in the JIS, respectively.

TABLE 1

| Sample | Present invention | Control (a) | Control (b) | Control (c) |
|---|---|---|---|---|
| Fastening element | Nylon 210 d/10f | Polyester 120 d/1f | Polyester 120 d/1f | PP* 300 d/1f |
| Thickness (mm) | 0.8 | 0.8 | 1.45 | 1.20 |
| Peel engaging force (g/25 mm) | 250 | 84 | 350 | 255 |
| Shear engaging force (kg/20 × 25 mm) | 8.0 | 7.5 | 3.3 | 6.4 |
| Softness | ⊙ | Δ | Δ | x x |
| Touch | o | Δ | Δ | x |
| Thermal deformation | o | Δ | — (not heated) | Δ |

*: polypropylene
Notes ⊙: excellent; o: good; x: bad; x x: very bad

The separable fastening component according to the present invention obtained in this Experimental Example had a small thickness of 0.8 mm, exhibited a sufficient engaging force and had a soft touch, with the fastening elements being flexible. On the other hand, Control (a), having fastening elements each comprising a match-shaped polyester monofilament (120 deniers; 0.11 mm-ϕ) having a swollen head formed by heating, had a low engaging force, particularly a low peel engaging force. This Control, using thick monofilaments, had coarse and rigid fastening elements and the base had become stiff and thermally deformed slightly. Control (b), having hooks formed by cutting with a clipper loops comprising the same monofilaments as in (a), could not be made thinner than the level shown and had some problems in flexibility and touch. Control (c), having fastening elements each comprising a thick (300 deniers) polypropylene monofilament with swollen head formed by heating, had problems in softness and touch and had not so small a thickness of 1.2 mm with its base showing thermal deformation and could not be made thinner than this level.

Separately conducted was a test comprising engaging two pieces of the separable fastening components of the present invention with each other like homo-type separable fasteners. The resulting peel engaging force and shear engaging force were very low and below measurement limits.

Obviously, numerous modifications and variations of the present invention are possible in light of the above teachings. It is therefore to be understood that within the scope of the appended claims, the invention may be practiced otherwise than as specifically described herein.

What is claimed is:

1. A separable fastener for a male-female separable fastener comprising:

a base, and provided on said base, a multiplicity of independent fastening elements, said fastening elements each comprising a bundle of fibers having bottoms raised from adjacent one point on the surface of the base, wherein pairs of said bundles are located close to each other and are oriented so as to form an X-shape, thereby producing a high engaging force, and wherein fibers constituting said bundles each have a fineness of 5 to 100 deniers and a swollen head, a part of the swollen heads of said fibers being a least partially consolidated, such that said fibers are flexible between the bases of said fibers and the at least partially consolidated swollen heads.

2. The separable fastening component according to claim 1, wherein said bundle of raised fibers tightens at the root part thereof and broadens towards to the top end.

3. The separable fastening component according to claim 1, wherein said fibers constituting said fastening elements have swollen heads having non-uniform shapes and heights from the base surface.

4. The separable fastening component according to claim 1, wherein said fastening elements each comprises a bundle of fibers raised from substantially one point on the surface of the base and form pairs of bundles which are located close to each other.

5. The separable fastening component according to claim 1, wherein said fastening elements each comprises a bundle of fibers raised from substantially one point on the surface of the base and form pairs of the bundles which are located close to each other, at least part of said pairs each being consolidated at the swollen head parts of the two fastening elements constituting said pair.

6. The separable fastening component according to claim 1, wherein said fastening elements each comprises a bundle of fibers raised from substantially one point on the surface of the base and forms a pair of bundles which are located close to each other in such relative positions as to form the X-shape, at least part of said pairs each being consolidated at the swollen head parts of the two fastening elements constituting said pair.

7. The separable fastening component according to claim 1, wherein said bundle of raised fibers has a total fineness of 50 to 300 deniers.

8. The separable fastening component according to claim 1, wherein said fastening elements comprise bundles of 4 to 60 pieces of raised fibers.

* * * * *